US007188837B2

(12) United States Patent
Bokelman et al.

(10) Patent No.: US 7,188,837 B2
(45) Date of Patent: Mar. 13, 2007

(54) MEDIA DETECTION

(75) Inventors: Kevin Bokelman, San Diego, CA (US); Craig A. Maurer, San Diego, CA (US); Daniel H. Wee, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 371 days.

(21) Appl. No.: 10/789,633

(22) Filed: Feb. 27, 2004

(65) Prior Publication Data

US 2005/0189709 A1 Sep. 1, 2005

(51) Int. Cl.
*B65H 7/02* (2006.01)

(52) U.S. Cl. ..... 271/265.01

(58) Field of Classification Search ..... 271/265.01, 271/265.02, 266

See application file for complete search history.

(56) References Cited

U.S. PATENT DOCUMENTS 5,172,904 A 12/1992 Sze et al.
5,450,158 A 9/1995 Jessen et al.
5,833,227 A * 11/1998 Choho et al. ..... 271/10.03
5,882,130 A 3/1999 Kumazaki et al.
5,895,928 A 4/1999 Kerschner
5,964,460 A * 10/1999 Azumi et al. ..... 271/265.01
6,022,012 A 2/2000 Worley
6,152,443 A 11/2000 Claramunt et al.
6,279,899 B1 8/2001 Coffey et al.
6,542,263 B2 4/2003 Emmenegger et al.
6,646,768 B1 11/2003 Andersen et al.
6,783,026 B2 * 8/2004 Chambers et al. ..... 271/265.01
6,926,272 B2 * 8/2005 Carter et al. ..... 271/258.01
7,021,622 B2 * 4/2006 Carter et al. ..... 271/258.01

FOREIGN PATENT DOCUMENTS

DE 4125450 2/1993
JP 04116043 A * 4/1992
JP 04292353 A * 10/1992

* cited by examiner

*Primary Examiner*—Patrick Mackey
*Assistant Examiner*—Kaitlin Joerger

(57) ABSTRACT

A media detection system includes a sensor and a flag. The flag is pivotally supported proximate to a media path through which media is moved. The flag pivots as media is moved through the media path such that the flag interacts with the sensor to cause the sensor to alternate between two states and to produce at least four signals representing positioning of the media along the path. The flag is configured to remain substantially in one angular position for a portion of time while the medium is moving and in contact with the flag.

37 Claims, 5 Drawing Sheets

MEDIA DETECTION

BACKGROUND

Many of today's electronic devices interact with some form of media in a repeated automatic fashion. Examples of media include paper, cardboard, fabric, polymers and the like. Such electronic devices typically include feed devices that automatically and repeatedly supply individual sheets or pieces of media to a mechanism that interacts with the individual sheets or pieces of media. For example, many scanning electronic devices include automatic document feeders that feed individual sheets along a path to a scanning mechanism. Printers and copiers frequently include an automatic document feeder that feeds individual sheets of media along a path to an inkjet or an electrophotographic printing mechanism.

In some of such systems, it may be desirable to accurately and precisely detect the positioning of the media as it is being fed along the media path to properly sequence the feeding of individual sheets, to initiate scanning or printing at the proper time and to identify malfunctioning of the electronic device or jamming of the media within the device. At the same time, it may be desirable that any mechanism used for detecting the position of media within the device be compact, simple to manufacture and assemble as part of the device, and inexpensive.

DETAILED DESCRIPTION OF EXAMPLE EMBODIMENTS

Figure 1:
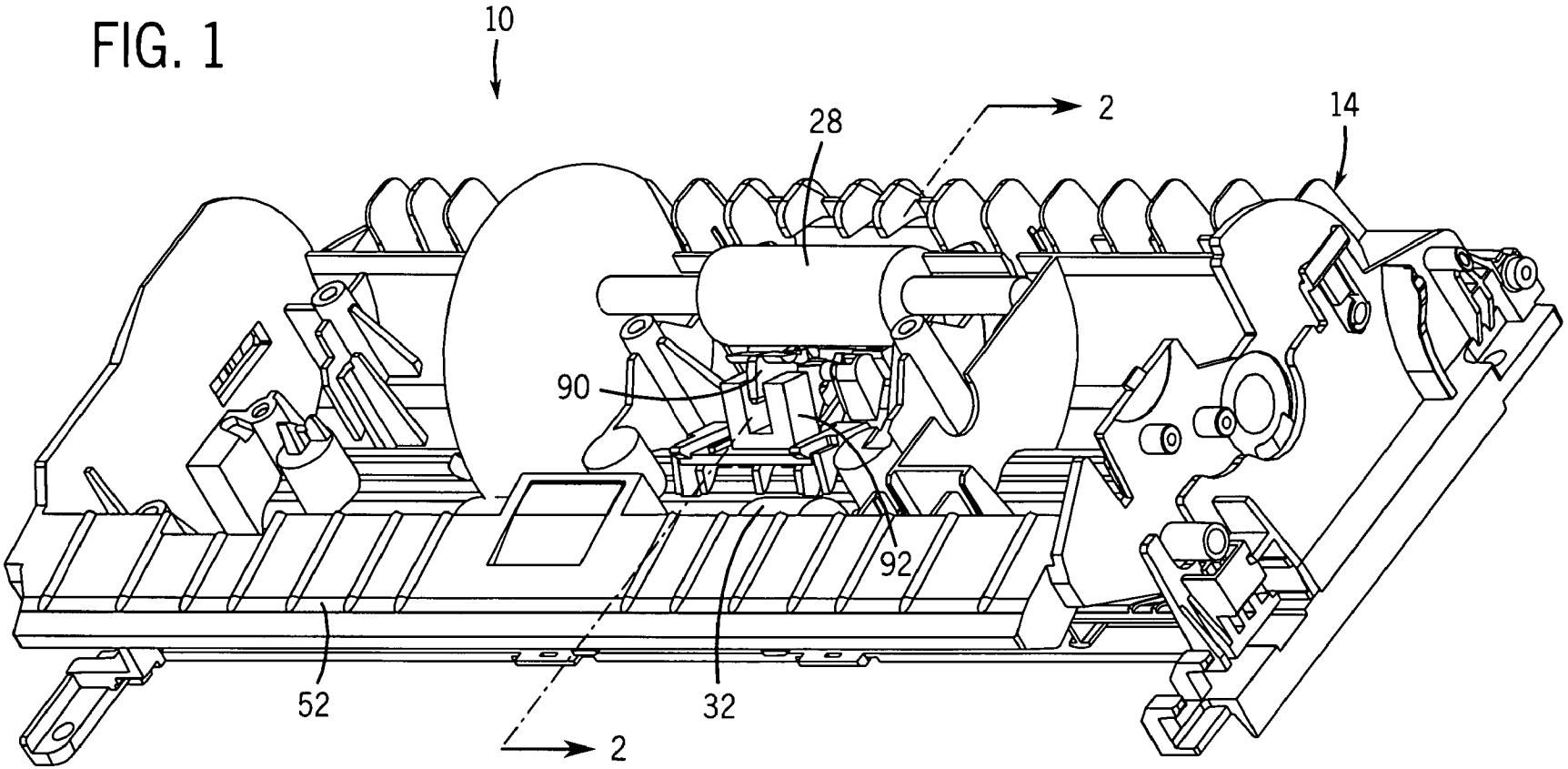
FIG. 1 is a perspective view of an example of media feed device including a media detection system, with portions removed for purposes of illustration.
Figure 2:
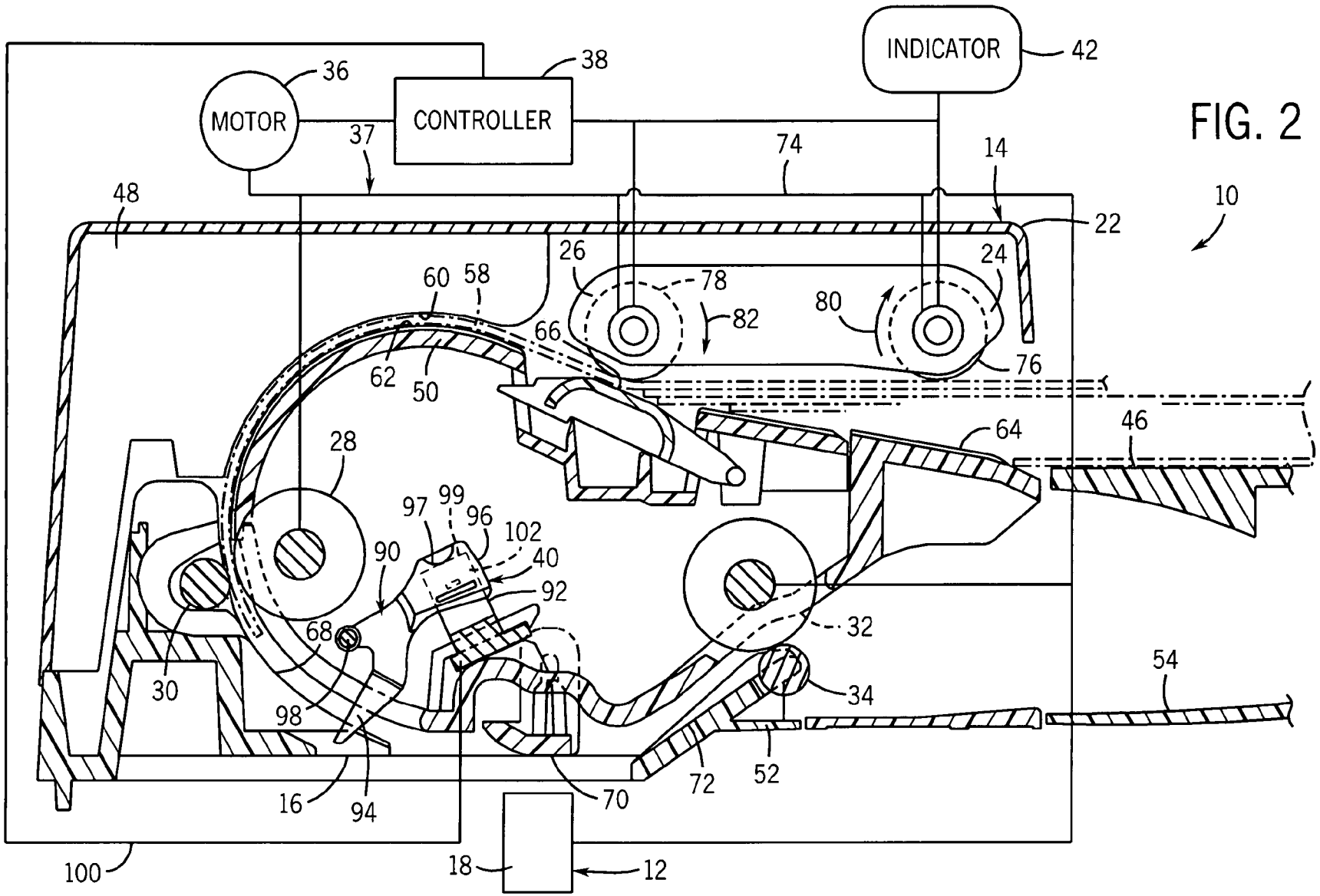
FIG. 2 is a sectional view of the media feed device of FIG. 1 coupled to a media interaction device to form a media interaction system, according to an example embodiment.

FIGS. 1 and 2 illustrate media interaction system 10 which generally includes media interaction device 12 and media feed device 14. FIG. 1 is a top perspective view of media feed device 14 with portions removed for purposes of illustration. FIG. 2 is a sectional view of media interaction system 10 with portions schematically illustrated. Media interaction device 12 generally comprises a device configured to receive image data from a medium fed by media feed device 14 and/or configured to transmit image data to the medium fed by media feed device 14. In the particular embodiment illustrated, media interaction device 12 comprises a scanning system having a generally flat, partially transparent bed 16 (only a portion of which is shown) and an image data interaction mechanism 18 which comprises a scanner. Image interaction mechanism 18 generally extends below bed 16 and is configured to read image data from the medium fed by media feed device 14. Media interaction mechanism 18 extends across a width of bed 16 so as to read an entire width of the medium passing along a surface of bed 16 opposite mechanism 18. The information read by mechanism 18 is utilized by device 12 and is transmitted for further manipulation such as being recorded and stored, such as being printed upon another medium or for being transmitted electronically.

In another embodiment, media interaction device 12 comprises a device configured to transmit image data to the medium in the form of ink, toner or other image-forming material. In such an embodiment, bed 16 is omitted and media interaction mechanism 18 provides a mechanism specifically configured to deposit the image-forming material upon the surface of the medium. For example, in one embodiment, media interaction mechanism 18 comprises a printhead configured to deposit ink upon the medium. Mechanism 18 may comprise a page-wide array of printheads or may comprise a printhead scanned across the medium as the medium moves relative to the printhead. In yet another embodiment, mechanism 18 may comprise an electrophotographic system including a photoconductive drum and configured to apply toner to the medium. In particular embodiments, system 10 may include two interaction devices 12 and two feed devices 14. For example, system 10 may include a media feed device 14 which feeds media to an interaction device 12 having a mechanism 18 configured to read data upon the medium and a second medium feed device 14 configured to feed media to a second interaction device 12 having an interaction mechanism 18 configured to form images upon the medium based upon the images read from the first medium.

Media feed device 14 feeds individual sheets of media to media interaction device 12. For purposes of this disclosure, the term "media" means any material in general sheet form upon which an image is already formed or upon which an image may be formed or may have material deposited thereon. Examples of media include fabrics, polymers, cellulose-based materials (i.e., paper, cardboard and the like) or combinations thereof. Media feed device 14 generally includes housing 22, media transfer member 24, media transfer member 26, media transfer members 28, 30, 32 and 34, motor 36, drive train 37, controller 38, media detection system 40 and media jam indicator 42.

Housing 22 generally comprises a variety of structures configured to be removably mounted to media interaction device 12 so as to automatically direct media sheets across interaction mechanism 18. As a result, media feed device 14 may be provided as an add-on to existing media interaction device 12 and may be separated from device 12 for modification or repair. In alternative embodiments, media feed device 14 may alternatively be permanently configured as part of system 10 with device 12. Housing 22 includes media input 46, cover 48, upper chassis 50, lower chassis 52 and media output 54.

Media input 46 is configured to receive and store a stack of media until the media is transported by transfer members 24 and 26. In the particular embodiment illustrated, input 46 comprises an input tray configured to load a stack of sheets into engagement with media transfer member 24. Although input 46 is illustrated as having a generally horizontal opening while supporting a stack of media in a horizontal orientation, input 46 may alternatively be configured to support media in a vertical orientation.

Cover 48, upper chassis 50 and lower chassis 52 cooperate with one another to form media path 58 from input 46 to output 54. In the particular embodiment illustrated, cover 48, upper chassis 50 and lower chassis 52 are removably mounted to one another. In alternative embodiments, one or more of these structures may be integrally formed with one another. Cover 48 supports members 24 and 26 opposite upper chassis 50 proximate to input 46. Cover 48 includes curved surface portion 60 which faces an opposite curved surface portion 62 of upper chassis 50 to form an arcuate narrow portion of media path 58 through which media travels from member 26 to member 28.

In addition to providing curved surface portion 62, upper chassis 50 additionally includes floor 64 and pinch surface 66. Floor 64 extends below media transfer member 24 and is spaced from media transfer member 24 for the insertion of a stack of media. Pinch surface 56 extends opposite media transfer member 26 and is sufficiently close to member 26 so as to form a nip for controlling the number of sheets of media that are fed at a time by member 26 between surfaces 60 and 62 to member 28.

Lower chassis 52 supports rollers 28, 30, 32, 34 and media detection system 40 generally between upper chassis 50 and at least portions of media interaction device 12. As shown best shown by FIG. 2, lower chassis 52 includes media guide surface 68, shoe 70 and media guide surface 72. Guide surface 68 comprises a curved surface configured to guide and direct media after the media has partially passed through member 28 and member 30. Surface 68 directs the media into contact with media detection system 40 and further into contact with bed 16 opposite interaction mechanism 18. Shoe 70 is generally adjustable and is configured to force the medium into close proximity with bed 16 opposite mechanism 18. Surface 72 contacts and guides the media after being interacted upon by interaction mechanism 18 into engagement with members 32 and 34, whereby the medium is ejected to output 54.

Output 54 generally comprises a location for storing media which has been interacted upon. In one embodiment, output 54 is configured to store media which has been scanned or read. In another embodiment, output 54 is configured to store media which has been printed upon. In the embodiment illustrated, output 54 comprises an output tray. In alternative embodiments, output 54 may comprise other structures and may be configured to store the interacted upon media in a substantially vertical orientation.

Media transfer members 24, 26, 28 and 32 operate in a media driving state in which such members engage a medium to move the medium towards or along media path 58 and an inactive or non-driving state in which such members do not drive or move the medium towards or along media path 58. For example, one of media transfer members 24, 26, 28 and 32 may be moved out of engagement with the media while in the non-driving state or may not be rotatably driven while in engagement with the medium and while in the non-driving state.

Media transfer member 24 is driven by motor 36 and is configured to pull one or more sheets of media from a stack of media and transport the pulled sheets of media to a nip between surface 66 and media transfer member 26. Media transfer member 26 is driven by motor 36 and is configured to separate and transport a single sheet of the medium between surfaces 60 and 62 to media transfer member 28. Media transfer member 28 is driven by motor 36 and is configured to engage and drive a single medium against member 30 along surface 68 and into engagement with media detection system 40, to a position opposite interaction mechanism 18 and eventually to media transfer member 32. Media transfer member 32 is driven by motor 36 and is configured to contact and move a medium against member 34 to output 54. Media transfer members 30 and 34 generally comprise movable surfaces against which members 28 and 32 press media 112 to move media 112 along path 58. In the embodiment illustrated, members 30 and 34 comprise pinch rollers. In an alternative embodiment, members 30 and 32 may be replaced by stationary surfaces opposite members 28 and 32.

Although each of members 24, 26, 28 and 32 are illustrated as being driven by a single motor 36, such members may alternatively be driven by independent motors or other power sources. In the particular embodiment illustrated, each of members 24, 26, 28, 30, 32 and 34 comprise rollers having surfaces configured to grip media. In alternative embodiments, one or more of media transfer members 24, 26, 28 and 32 may alternatively comprise belts movable about two or more rollers or pulleys, wherein the belts contact the media to exert a force upon the media to facilitate movement the media along media path 58. Although media feed device 14 is illustrated as including four driven media transfer members 24, 26, 28 and 32, device 14 may alternatively include a greater or fewer number of such media transfer members.

Motor 36 comprises a mechanism configured to supply rotational power or torque to each of members 24, 26, 28 and 32. In the particular embodiment illustrated, motor 36 comprises an electrically powered servomotor. In alternative embodiments, motor 36 comprises a stepper motor, an electric motor, a hydraulic motor or a pneumatic motor. Motor 36 is operably coupled to each of members 24, 26, 28 and 32 by drive train 37.

Drive train 37 transmits rotational torque from motor 36 to one or more of members 24, 26, 28 and 32. In the particular embodiment illustrated, drive train 37 includes one or more shafts and one or more gears schematically illustrated and identified by reference numeral 74 between motor 36 and members 24, 26, 28 and 32 and one-way clutches 76, 78. Clutches 76 and 78 move between a torque transmitting state and a torque non-transmitting state by means of actuators (not shown) which actuate one-way clutches 76 and 78 between the states in response to control signals from controller 38. Clutches 76 and 78 are specifically configured to permit the transmission of torque in the direction indicated by arrows 80 and 82, respectively. Clutches 76 and 78 freely rotate in opposite directions. In other embodiments, drive train 37 may include hydraulic or pneumatic lines for transmitting power and may utilize other forms of clutches for transmitting torque to members 24 and 26. As noted above, in other embodiments, one or more of members 24, 26, 28 and 32 may alternatively utilize independent motors and drive trains.

Controller 38 generally comprises a processor unit configured to generate control signals. For purposes of this disclosure, the term "processor unit" shall mean a conventionally known or future developed processing unit that executes sequences of instructions contained in a memory.

Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 38 is not limited to any specific combination of hardware circuitry and software, nor to any particular source for the instructions executed by the processing unit. In the particular embodiment illustrated, controller 38 generates such control signals based at least in part upon signals from media detection system 40.

Media detection system 40 comprises an arrangement configured to detect movement of medium along media path 58. Media detection system 40 is configured to specifically identify at least four distinct locations, or states, of the medium along media path 58. Media detection system 40 includes flag 90 and sensor 92. Flag 90 comprises a member having a first portion 94 projecting into media path 58 and a second portion 96 interacting with sensor 92. Flag 90 is configured to pivot about axis 98 in response to a medium along media path 58 contacting and being moved against portion 94 so as move portion 96 relative to sensor 92. Flag 90 moves between a first position in which portion 94 is situated within media path 58 and out of contact with a medium, a second position in which movement of the medium along path 58 has pivoted flag 90 a first angular extent about axis 98, a third position in which movement of a medium along media path 58 has pivoted flag 90 a second greater extent about axis 98 and a fourth position in which movement of the medium along path 58 has further pivoted flag 90 about axis 98 to an extent such that portion 94 is no longer within media path 58 and such that the medium passes below portion 94 as it moved toward interaction mechanism 18.

Sensor 92 comprises a sensing mechanism configured to detect movement of flag 90 between the four positions. Sensor 92 is configured to alternate between two states. In the particular embodiment illustrated, sensor 92 comprises an optical sensor having a photo emitter 108 and a photo detector 110 (shown in FIGS. 7 and 8) spaced by a gap in which portion 96 of flag 90 extends. In other embodiments, other sensors may be employed for detecting movement of flag 90 about axis 98.

The relative movement of portion 96 as flag 90 is moved between the four positions alternately (1) blocks and prevents the photo detector 110 from receiving light emitted by the photo emitter 108 and (2) allows detector 110 to receive light from emitter 108. As a result, detector alternates between a first state in which a first voltage signal is transmitted to controller 38 and a second state in which a second voltage signal is transmitted to controller 38. In one embodiment, sensor 92 produces a high voltage signal in response to flag 90 blocking light emitted by photo emitter 108 and a low voltage signal in response to photodetector 110 receiving light from emitter 108. The alternating voltage signals produced by sensor 92 as flag 90 is pivoted represent four locations of media along media path 58. Depending upon their timing and relative spacing, the alternating voltage signals also function as four distinct position signals. For example, a first occurrence of a first voltage signal functions as a first position signal indicating that media is at a first location, or state, along media path 58. A first occurrence of a second voltage signal functions as a second position signal indicating that the media is at a second location, or state, along the media path 58. A second occurrence of the first voltage signal functions as a third position signal indicating that the media is at a third location, or state, along the media path 58. A second occurrence of the second voltage signal functions as a fourth position signal indicating that the media is at a fourth location, or state, along the media path 58. Because flag 90 and sensor 92 interact with one another to produce four position signals representing four locations, or states, of the media along path 58 using only a two-state sensor, media detection system 40 is relatively simple and inexpensive.

The voltage signals produced by sensor 92 are communicated to controller 38 via communication line 100. Communication line 100 simply represents a communication between sensor 92 and controller 38. Communication line 100 may comprise an electrically conductive wire, an electrically conductive trace, an optical communication line, or the wireless transmission of signals.

Indicator 42 comprises a mechanism configured to produce a signal to indicate malfunctioning of media feed device 14. In the particular embodiment illustrated, indicator 42 is configured to indicate jamming or interruption of movement of media along media path 58. Indicator 42 produces one or both of a visual signal such as a lit up display or flashing light or an auditory signal such as a beeping sound in response to particular signals from controller 38.

Figure 3:
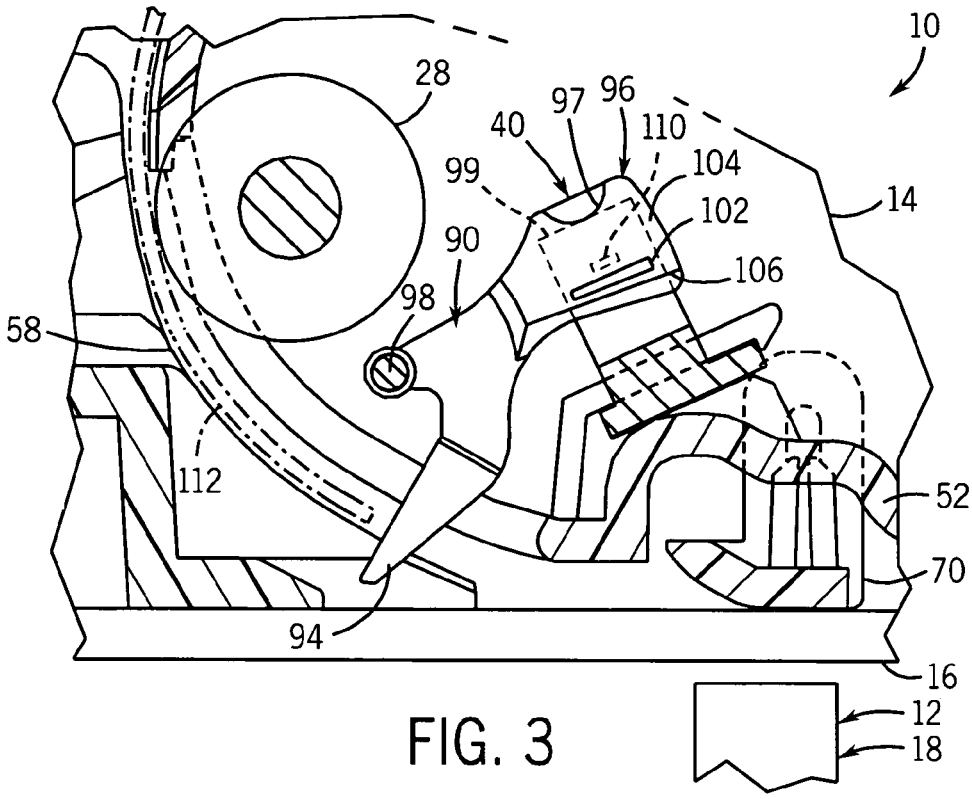
FIG. 3 is an enlarged fragmentary view of the media interaction system of FIG. 2 illustrating a flag of a media detection system in a first position, according to an example embodiment.

FIGS. 3 through 8 illustrate the operation of media detection system 40 in greater detail. As shown by FIG. 3, interaction portion 96 of flag 90 includes a window 102 located between an upper blocking portion 104 and a lower blocking portion 106. Window 102 is configured to allow the light being emitted by photo emitter 108 to be received by photo detector 110. Blocking portions 104 and 106 are configured to sufficiently block the light being emitted by emitter 108 so as to prevent receipt of the beam by detector 110.

FIG. 3 further illustrates medium 112 moving along media path 58 just prior to engaging portion 94 of flag 90. Prior to engagement of medium 112 with portion 94, flag 90 is in the first position. In the particular embodiment illustrated, flag 90 is biased to the first position by gravity. In other embodiments, flag 90 may be biased to the first position by one or more springs. When flag 90 is in the first position, blocking portion 104 extends between emitter 108 and detector 110 which results in a first position signal being transmitted to controller 38 by communication line 100 (shown in FIG. 2).

In response to receiving the first position signal, controller 38 generates first control signals which are transmitted to motor 36 and to clutches 76, 78. In response to the first control signals, actuators (not shown) position or maintain clutches 76 and 78 in a torque transmitting state. Motor 36 drives members 24, 26, 28 and 32 to move medium 112 along media path 58.

Figure 4:
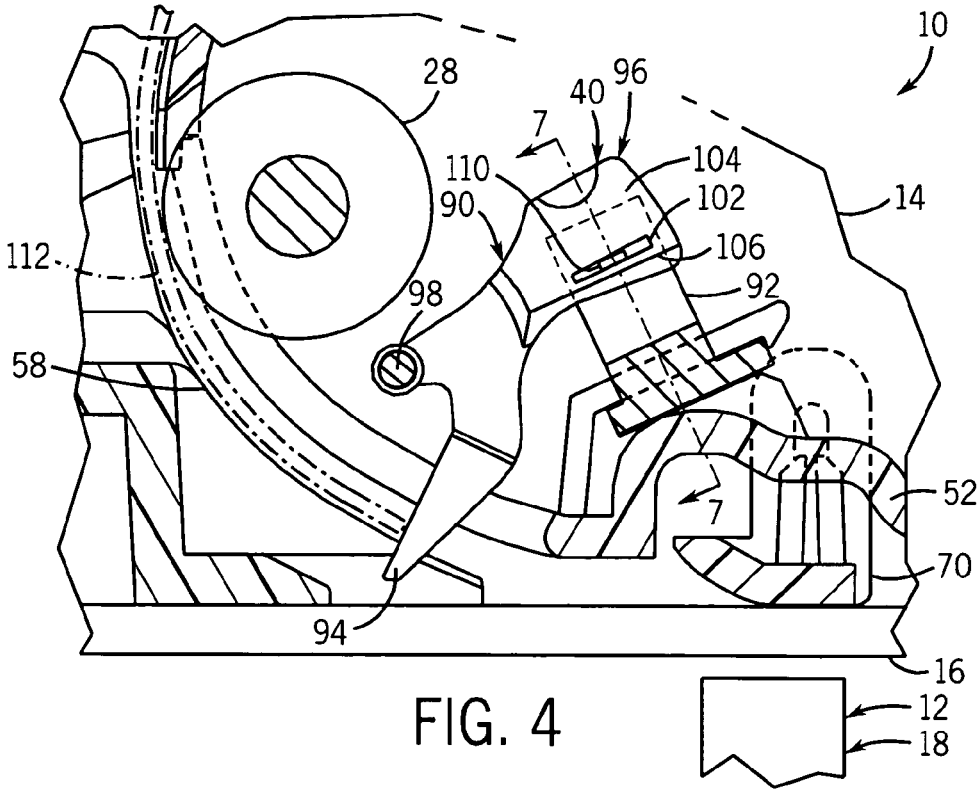
FIG. 4 is an enlarged fragmentary view of the media interaction system of FIG. 2 illustrating the flag of the media detection system in a second position, according to an example embodiment.
Figure 7:
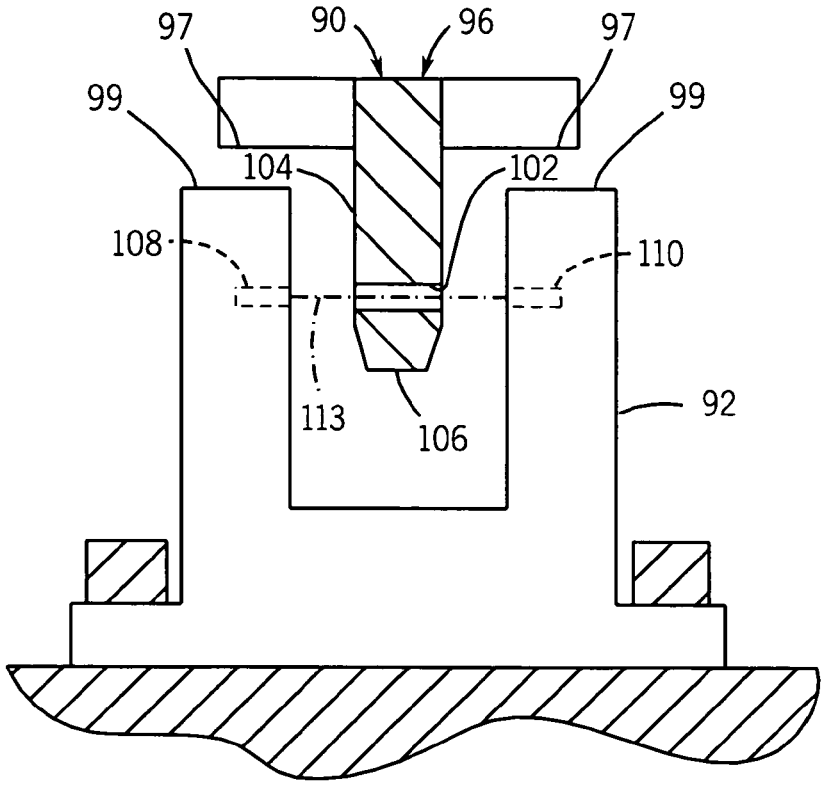
FIG. 7 is a sectional view of the media detection system of FIG. 4 taken along line 7—7, according to an example embodiment.

FIG. 4 illustrates medium 112 further along media path 58 into engagement with portion 94 of flag 90. FIG. 4 further illustrates flag 90 pivoted as a result of the movement of medium 112 to a second position in which window 102 is in alignment with emitter 108 and detector 110. As shown by FIG. 7, this results in light beam 113 emitted by emitter 108 to be received by detector 100 which causes a second position signal to be generated by sensor 92 and to be transmitted to controller 38 by communication line 100.

In response to receiving the second position signal, controller 38 generates second control signals which are transmitted to clutches 76 and 78. In particular, the actuators (not shown) connected to clutches 76 and 78 actuate clutches 76 and 78 to torque non-transmitting states in response to the second control signals. As a result, the amount of drag experienced by member 28 is reduced. In particular embodiments, one or more of members 24 and 26 are further moved out of contact and engagement with medium 112 in response to the second control signals.

Figure 5:
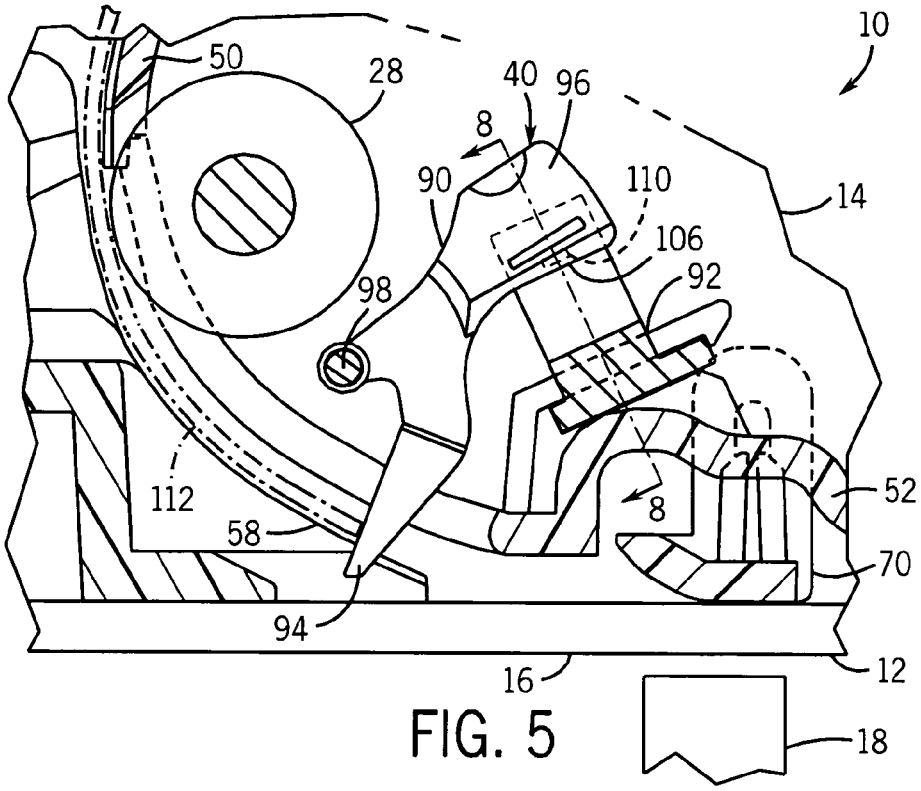
FIG. 5 is an enlarged fragmentary view of the media interaction system of FIG. 2 illustrating the flag of the media detection system in a third position, according to an example embodiment.
Figure 8:
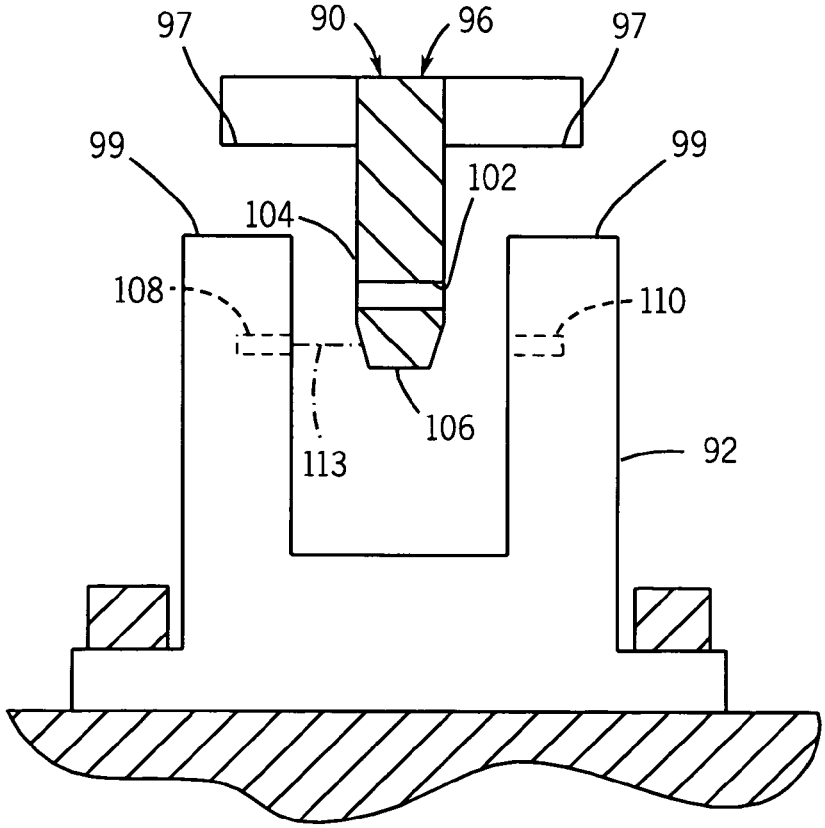
FIG. 8 is a fragmentary sectional view of the media detection system of FIG. 5 taken along line 8—8, according to an example embodiment.

FIG. 5 illustrates further pivotal movement of flag 90 to a third angular position with respect to axis 98 brought about by further movement of medium 112 along path 58 while in engagement with portion 94 of flag 90. As shown by FIG. 8, in the third position, blocking portion 106 of flag 90 is located between emitter 108 and detector 110 to prevent the light beam 113 emitted by emitter 108 from being received by detector 110. As a result, sensor 92 produces a third position signal which is transmitted to controller 38 by communication line 100.

In response to receiving the third position signal, controller 38 generates third control signals. In particular; controller 38 utilizes the third position signals either alone or with other data, such as the second position signals, to calculate when interaction mechanism 18 should be actuated to an active state. For example, in one embodiment, controller 38 may utilize time of receipt of the second position signals and the time of receipt of the third position signals to calculate the speed at which medium 112 is being moved along paper path 58 so as to more accurately determine when to actuate interaction mechanism 18 to an active state. In another embodiment, controller 38 may simply utilize the third position signal, the known rate at which motor 36 moves medium 112 and the known distance of medium 112 to the interaction position opposite mechanism 18 to calculate when to actuate mechanism 18. Interaction mechanism 18 actuates to the active state in response to receiving the third control signals. In other embodiments, controller 38 may be configured to produce the third control signals utilizing additional information received from system 10. In other embodiments, controller 38 may also utilize information obtained from the third position signal for other purposes.

Figure 6:
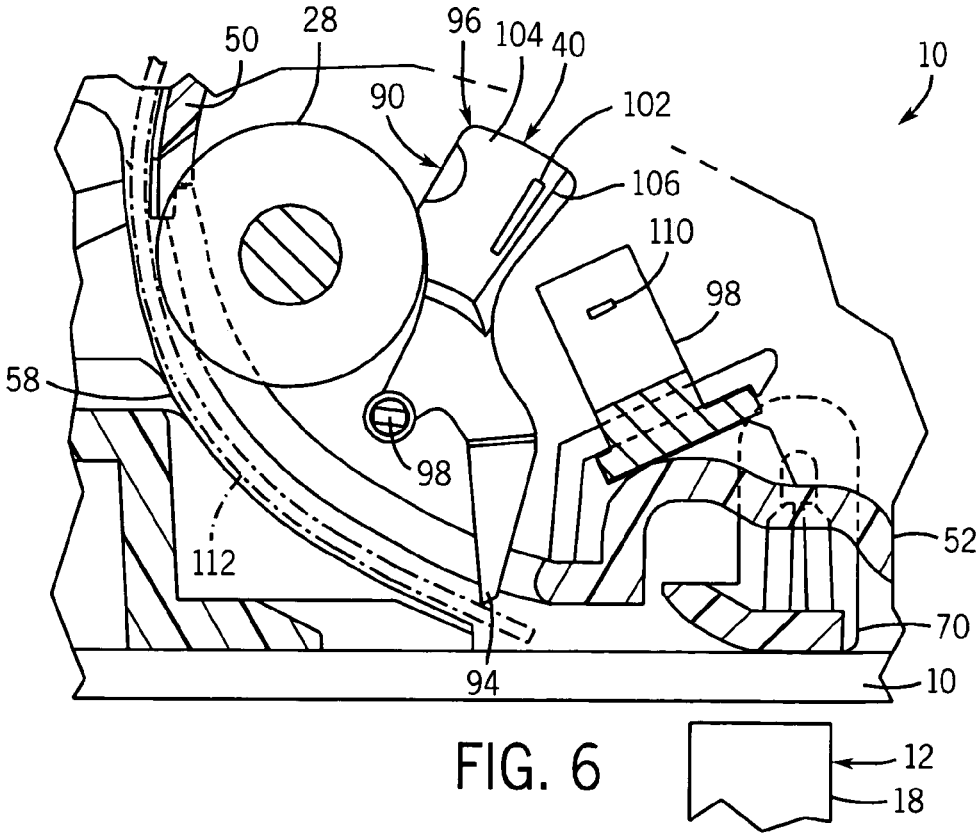
FIG. 6 is an enlarged fragmentary view of the media interaction system of FIG. 2 illustrating the flag of the media detection system in a fourth position, according to an example embodiment.

FIG. 6 illustrates flag 90 pivoted to a fourth position by movement of medium 112 along media path 58. In the fourth position, portion 94 of flag 90 has been rotated about axis 98 to a sufficient extent such that medium 112 passes below portion 94. As a result, continued movement of medium 112 relative to portion 94 of flag 90 does not result in further pivoting of flag 90 about axis 98. As shown by FIG. 6, when flag 90 is in the fourth position, portion 96 is pivoted to a sufficient extent such that none of portion 96 extends below or interrupts beam of light 113 emitted by emitter 108. In the particular embodiment illustrated, the entirety of portion 96 is pivoted away from sensor 92. As a result, the beam of light 113 emitted by emitter 108 is received by detector 110 such that sensor 92 produces a fourth position signal which is transmitted to controller 38 by communication line 100.

Controller 38 generates fourth control signals based at least in part upon the fourth position signals from sensor 92. In one scenario, controller 38 generates fourth control signals which are transmitted to interaction mechanism 18 to actuate interaction mechanism 18 between the inactive and active states. In particular, controller 38 is configured to calculate time at which mechanism 18 should be actuated to an active state based upon the receipt of the fourth position signal and/or based upon a calculated movement rate of medium 112 along media path 58 by using the time of receipt of the fourth position signal and the time of receipt of either the second position signal or the third position signal.

In another scenario, controller 38 is configured to generate fourth control signals in response to receiving the fourth position signals for a predetermined period of time or in response to receiving the fourth position signal and not receiving a varying signal for a predetermined period of time. In particular, continued movement of medium 112 along media path 58 eventually results in a tail end of the medium 112 being moved past portion 94 of flag 90. As the tail end of the medium 112 moves past portion 94, flag 90 pivots in a clockwise direction (as seen in FIG. 6) about axis 98 to the first position shown in FIG. 3. During this pivotal movement, blocking portion 106 first interrupts light beam 113, window 102 permits the receipt of beam 113 by detector 110 and blocking portion 104 interrupts beam 113. These signals occur in quick succession. Controller 38 is configured to recognize the quick succession of position signals from sensor 92 so as to generate fifth control signals. In response to the fifth control signals, the actuators (not shown) actuate clutches 76 and 78 to torque-transmitting positions. As a result, members 24 and 26 move a new media sheet along media path 58.

In the event of a jam, medium 112 becomes stationary along media path 58 such that flag 90 is held in the fourth position shown in FIG. 6. In one embodiment, sensor 92 continues to transmit the fourth position signal to controller 38. In another application, sensor 92 does not transmit any additional position signals to controller 38, indicating the stationary status of flag 90. In both applications, controller 38 generates fourth control signals in response to either receiving the fourth position signal for a predetermined period of time or in response to not receiving any signals other than the fourth position signal for a predetermined period of time. Indicator 42 indicates a paper jam in response to the fourth control signals. As noted above, indicator 42 may be configured to produce one or both of either a visual display signal or an auditory signal indicating a media jam.

Overall, some embodiments of the media detection system 40 provide media feed device 14 with a simple, compact and inexpensive arrangement for detecting movement of a medium along a media path through at least four positions prior to being interacted upon by an interaction mechanism such as a scanner, an ink jet printhead or electrophotographic printing mechanism. Media detection system 40, according to some embodiments, enables the media feed device 14 to timely disengage one or more media transfer members from the media at least one location along the media path to reduce drag upon the media, saving power consumption and enabling smaller motors to be utilized. Media detection system 40, in some embodiments, further enables accurate and timely actuation of the media interaction mechanism 18 between active and inactive states. Furthermore, media detection system 40 facilitates the detection of a media jam and enables the jam to be appropriately indicated to an operator.

Although the present invention has been described with reference to example embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media detection system comprising:

a sensor;

a flag pivotally supported proximate to a media path through which media is moved, wherein the flag includes a discontinuity and pivots as the media is moved through the mediapath such that the flag interacts with the sensor to cause the sensor to alternate between two states to produce position signals representing at least four distinct positions of the media along the path, wherein the flag is configured to be contacted for a time by the media as it moves and wherein the flag is configured to remain substantially in one angular position for a portion of the time while the medium is moving and in contact with the flag.

2. The system of claim 1, wherein the sensor comprises an optical sensor and wherein the discontinuity comprises a window that is pivoted relative to the optical sensor.

3. The system of claim 2, wherein the flag includes no greater than one window.

4. The system of claim 1, wherein the flag pivots less than 360 degrees.

5. The system of claim 1, wherein the flag pivots about an axis and wherein the flag nonsymmetrically extends from the axis.

6. A media feed device comprising:

a media path;

a first media transfer member configured to contact a medium and to move the medium along the media path;

a media detection system including:

a sensor; and a flag pivotally supported proximate to the media path through which media is moved, wherein the flag includes a discontinuity and pivots as the media is moved through the media path such that the flag interacts with the sensor to cause the sensor to alternate between two states to produce at least four position signals representing at least four distinct positions of the media along the path, wherein the flag is configured to remain substantially in one angular position for a portion of the time while the medium is moving and in contact with the flag.

7. The device of claim 6, including a second media transfer member configured to contact the medium and to move the medium along the path to the first transfer member.

8. The device of claim 6 wherein the feeder has a media input and is configured for use with a media interaction device having a media interaction mechanism that interacts with the medium for the transfer of image data in at least one direction between the medium and the interaction device and wherein the flag is configured to extend into the media path between the input and the interaction mechanism.

9. The device of claim 6 including:

a second media transfer member configured to contact the medium and to move the medium along the path to the first transfer member;

a controller in communication with the sensor; and an actuator in communication with the controller and operably coupled to the second media transfer member, wherein the flag is biased towards a first position when not in engagement with the medium, wherein the sensor produces a first position signal in response to the flag being in the first position and wherein the controller generates first control signals based upon the first position signal.

10. The device of claim 9, wherein the second media transfer member is in a medium driving state in response to the first control signal.

11. The device of claim 10, wherein the flag is configured to be pivoted by the medium moving along the path from the first position to a second position, wherein the sensor is configured to produce a second position signal in response to the flag being in the second position and wherein the controller is configured to generate second control signals based upon the second position signal.

12. The device of claim 11, wherein the second media transfer member moves to a non-driving state in response to the second control signals.

13. The device of claim 11, wherein the flag is configured to be pivoted to a third position by the medium moving along the path, wherein the sensor is configured to produce a third position signal in response to the flag being in the third position and wherein the controller is configured to generate third control signals based upon the third position signal.

14. The device of claim 13, wherein the controller is configured to transmit the third control signals to the interaction mechanism and wherein the interaction mechanism actuates between an active state and an inactive state in response to the third control signals.

15. The device of claim 13, wherein the flag is configured to be pivoted to a fourth position by the media moving along the path, wherein a sensor produces a fourth position signal in response to the flag being in the fourth position and wherein the controller generates a fourth control signal based upon the fourth position signal.

16. The device of claim 15 including a jam indicator which indicates a jam in response to the fourth control signal.

17. The device of claim 16, wherein the controller is configured to generate the fourth control signal in response to receiving the fourth position signal for a predetermined period of time.

18. A media interaction device comprising:

an image interaction mechanism;

a media path extending from a media input to the image interaction mechanism;

a media detection system including:

a sensor; and a flag pivotally supported proximate to a media path through which media is moved, wherein the flag includes a discontinuity and pivots as the media is moved through the media path such that the flag interacts with the sensor to cause the sensor to alternate between two states to produce at least four position signals representing at least four positions of the media along the path, wherein the flag is configured to be contacted for a time by the media as it moves and wherein the flag is configured to remain substantially in one angular position for a portion of the time while the medium is moving and in contact with the flag.

19. The device of claim 18, wherein the image interaction mechanism is configured to read image data from the medium.

20. The device of claim 19, wherein the image interaction mechanism comprises a scanner.

21. The device of claim 18 including a first medium transfer member configured to contact the medium and to move the medium along the media path.

22. The device of claim 21 including a second medium transfer member configured to contact the medium and to move the medium along the path to the first transfer member.

23. The device of claim 22 including a controller in communication with the sensor, wherein the sensor is configured to generate first position signals in response to the flag being in a first position prior to being in contact with the medium along the path, wherein the controller is configured to generate first control signals based upon the first position signals and wherein the first media transfer member and the second media transfer member are configured to drive the medium along the path in response to the first control signals.

24. The device of claim 23, wherein the flag is configured to be moved by the medium moving along the path from the first position to a second position, wherein the sensor is configured to generate a second position signal in response to the flag being in the second position, wherein the controller generates second control signals based upon the second position signal and wherein the second media transfer member is in a non-driving state in response to the second control signals.

25. The device of claim 24, wherein the flag is configured to be moved by the medium moving along the path from the second position to a third position, wherein the sensor is configured to produce a third position signal in response to the flag being in the third position, wherein the controller is configured to generate third control signals based upon the third position signal and wherein the image data interaction mechanism actuates between an active state and a non-active state in response to the third control signals.

26. The device of claim 25, wherein the flag is configured to be moved from a third to a fourth position by the media moving along the path, wherein the sensor is configured to produce a fourth position signal in response to the flag being in the fourth position, wherein the controller is configured to generate fourth control signals based at least in part on the fourth position signal.

27. The device of claim 26, including a jam indicator configured to indicate a jam in response to the fourth control signals.

28. The device of claim 27, wherein the controller generates the fourth control signals in response to receiving the fourth position signal for a predetermined period of time.

29. The device of claim 18, wherein the sensor comprises an optical sensor, wherein the flag includes a window which is pivoted relative to the optical sensor and wherein the flag is configured such that the window remains in one angular position for a portion of time as the medium is moved along the path in contact with the flag.

30. A method for interacting with a medium along a path, the method comprising:

locating a flag in the path in a first position relative to a sensor that alternates between two states;

producing a first position signal in response to the flag being in the first position;

pivoting the flag from the first position to a second position in response to movement of the medium along the path;

producing a second position signal in response to the flag being in the second position;

pivoting the flag from the second position to a third position in response to movement of the medium along the path;

producing a third position signal in response to the flag being in the third position;

pivoting the flag from the third position to a fourth position in response to movement of the medium along the path;

producing a fourth position signal in response to the flag being in the fourth position; and maintaining the flag in the fourth position until the medium disengages the flag.

31. The method of claim 30 including indicating a medium jam in response to receiving the fourth position signal.

32. The method of claim 30 including cessating transmission of moving force to the medium in at least one location along the path in response to receiving the second position signal.

33. The method of claim 30 including interacting with the medium to read image data from the medium or to form an image upon the medium based upon receipt of at least one of the second position signal and the third position signal.

34. A medium interaction device comprising:

a media path means for physically contacting a medium as the medium moves along the media path to alternate a sensor between two states to produce four position signals in response to the medium being located at four positions along the path, wherein the means produces one of the four position signals for a period of time as a majority of a surface of the medium moves along the path while in contact with the means.

35. The device of claim 34 including means for indicating a medium jam in response to said one of the four position signals being received for a predetermined period of time.

36. The device of claim 35 including means for terminating transmission of force to the medium at at least one location along the medium path in response to a second one of the four position signals.

37. A media detection system comprising:

a sensor;

a flag pivotally supported proximate to a media path through which media is moved, wherein the flag pivots as the media is moved through the media path such that the flag interacts with the sensor to cause the sensor to alternate between two states to produce position signals representing at least four distinct positions of the media along the path, wherein the flag is configured to be contacted for a time by the media as it moves and wherein the flag is configured to remain substantially in one angular position for a portion of the time while the medium is moving and in contact with the flag, wherein the sensor comprises an optical sensor and wherein the flag includes a window that is pivoted relative to the optical sensor.

* * * * *

UNITED STATES PATENT AND TRADEMARK OFFICE

CERTIFICATE OF CORRECTION

PATENT NO. : 7,188,837 B2
APPLICATION NO. : 10/789633
DATED : March 13, 2007
INVENTOR(S) : Kevin Bokelman et al.

It is certified that error appears in the above-identified patent and that said Letters Patent is hereby corrected as shown below:

On the title page, item (75), in "Inventors", in column 1, line 1, after "Kevin" insert -- L. --.

In column 9, line 13, in Claim 1, delete "mediapath" and insert -- media path --, therefor.

In column 9, line 45, in Claim 6, after "path," insert -- wherein the flag is configured to be contacted for a time by the media as it moves and --.

Signed and Sealed this

Eighteenth Day of November, 2008

JON W. DUDAS
*Director of the United States Patent and Trademark Office*